US008701608B2

(12) United States Patent
Xiong et al.

(10) Patent No.: US 8,701,608 B2
(45) Date of Patent: Apr. 22, 2014

(54) VARIABLE VALVE LIFT SYSTEM FOR AN INTERNAL COMBUSTION ENGINE

(75) Inventors: Zhijiang Xiong, Anhui (CN); Hui Zhao, Anhui (CN)

(73) Assignee: Chery Automobile Co., Ltd, Anhui (CN)

( * ) Notice: Subject to any disclaimer, the term of this patent is extended or adjusted under 35 U.S.C. 154(b) by 539 days.

(21) Appl. No.: 12/997,971

(22) PCT Filed: Jun. 12, 2009

(86) PCT No.: PCT/CN2009/072252

§ 371 (c)(1),
(2), (4) Date: Dec. 14, 2010

(87) PCT Pub. No.: WO2009/152746

PCT Pub. Date: Dec. 23, 2009

(65) Prior Publication Data

US 2011/0100311 A1 May 5, 2011

(30) Foreign Application Priority Data

Jun. 16, 2008 (CN) ..... 2008 1 0067764

(51) Int. Cl.
*F01L 1/34* (2006.01)

(52) U.S. Cl.
USPC ..... 123/90.16; 123/90.25; 123/90.39; 123/519

(58) Field of Classification Search
USPC ..... 123/90.16, 90.25, 90.39, 519, 90.44
See application file for complete search history.

(56) References Cited

U.S. PATENT DOCUMENTS 5,365,895 A * 11/1994 Riley ..... 123/90.16
5,572,962 A * 11/1996 Riley ..... 123/90.16
6,491,008 B1 12/2002 Zubeck
6,550,435 B1 * 4/2003 Zubeck ..... 123/90.16

(Continued)

FOREIGN PATENT DOCUMENTS

CN 1173214 2/1998
CN 1251637 4/2006

(Continued)

OTHER PUBLICATIONS

International Search Report; PCT/CN2009/072252; Sep. 17, 2009.

(Continued)

*Primary Examiner* — Thai Ba Trieu
*Assistant Examiner* — Thomas Olszewski
(74) *Attorney, Agent, or Firm* — Kilpatrick Townsend & Stockton LLP

(57) ABSTRACT

A variable valve lift system for an internal combustion engine includes a roller rocker lift mechanism and a driving mechanism. A cam and a roller of the roller rocker lift mechanism cooperate with each other to control valve lift. The roller rocker lift mechanism includes a second rocker arm, wherein one end of the second rocker arm is connected with the driving mechanism by a rotation pin so as to create a straight-line displacement of the driving mechanism; the second rocker arm is provided with a guideway in the direction of the straight-line displacement; a rocker-arm pin of the roller rocker lift mechanism is slidably set in the guideway of the second rocker. According to actual work condition of the internal combustion engine, the valve lift is regulated by a motor; and continuous variable valve lift is provided from low speed to high speed.

9 Claims, 5 Drawing Sheets

(56) References Cited

U.S. PATENT DOCUMENTS

| | | | | |
|---|---|---|---|---|
| 6,550,436 | B2 * | 4/2003 | Nohara et al. | 123/90.16 |
| 6,615,777 | B2 * | 9/2003 | Grau | 123/90.16 |
| 6,722,326 | B1 | 4/2004 | Shui et al. | |
| 6,739,296 | B2 * | 5/2004 | Machida | 123/90.16 |
| 7,243,625 | B2 * | 7/2007 | Shindou | 123/90.16 |
| 7,293,537 | B2 * | 11/2007 | Arai et al. | 123/90.16 |
| 7,305,946 | B2 * | 12/2007 | Nakamura et al. | 123/90.16 |
| 7,401,581 | B2 * | 7/2008 | Yamada | 123/90.16 |
| 7,430,997 | B2 * | 10/2008 | Muraji et al. | 123/90.16 |
| 7,484,485 | B2 * | 2/2009 | Nakamura et al. | 123/90.16 |
| 7,886,703 | B2 * | 2/2011 | Nakamura | 123/90.16 |
| 7,898,121 | B2 * | 3/2011 | Ramsay et al. | 310/14 |
| 8,191,522 | B2 * | 6/2012 | Riley | 123/90.39 |
| 8,316,807 | B2 * | 11/2012 | Methley et al. | 123/90.16 |
| 2003/0172888 | A1 * | 9/2003 | Miura | 123/90.16 |
| 2004/0069259 | A1 | 4/2004 | Shui et al. | |
| 2006/0011159 | A1 * | 1/2006 | Bloms et al. | 123/90.12 |
| 2006/0037578 | A1 * | 2/2006 | Nakamura | 123/198 F |
| 2007/0084426 | A1 * | 4/2007 | Seitz | 123/90.39 |
| 2010/0122678 | A1 * | 5/2010 | Kim | 123/90.16 |

FOREIGN PATENT DOCUMENTS

| | | | |
|---|---|---|---|
| CN | 101086212 | | 12/2007 |
| CN | 101403326 | | 4/2009 |
| DE | 19960742 | A1 | 6/2001 |
| DE | 10138741 | A1 | 2/2003 |
| JP | 2123215 | A | 5/1990 |

OTHER PUBLICATIONS

European Application No. 09765385.1, European Search Report, dated Dec. 29, 2011, 5 pages.

* cited by examiner

VARIABLE VALVE LIFT SYSTEM FOR AN INTERNAL COMBUSTION ENGINE

This application claims the priority of Chinese patent Application No. 200810067764.7, filed with the Chinese Intellectual Property Office on Jun. 16, 2008, entitled "VARIABLE VALVE LIFT MECHANISM OF INTERNAL COMBUSTION ENGINE", the entirety of which is hereby incorporated herein by reference.

FIELD OF THE INVENTION

The present invention relates to a control technology for a variable valve lift of an internal combustion engine. In particular, the invention relates to a continuous variable valve lift device of an internal combustion engine.

BACKGROUND OF THE INVENTION

The valve lift in existing valve actuating mechanism of an internal combustion engine mostly employs a fixed and constant structure or a non continuous variable structure. However, the internal combustion engine has different requirements on the valve actuating system under different working conditions and different speeds. When the internal combustion engine operates at a low speed, the flow inertia of gas is relatively small. At this time, if the valve lift is overlarge, a creation of inlet gas swirl will be hindered and the mixture of fuel and air will be unhomogeneous, thus hampering combustion. In this situation, under the impeding influence of throttle valves, a pump gas loss is caused, and the consumption of internal energy results in a reduction of working efficiency of part loads on the internal combustion engine. When the internal combustion engine operates at a high speed, the flow rate of gas is relatively large and the flow inertia is large too. In this situation, if the valve lift is oversmall, a strong swirl will be created in the inlet gas, which is also adverse to combustion. Therefore, a relatively large valve lift is required at this time so as to reduce swirl rate and bring about more inlet gas simultaneously.

SUMMARY OF THE INVENTION

The technical problem to be solved by the invention is to make up for the disadvantages in the prior art and to provide a continuous variable valve lift device from low speed to high speed so that the internal combustion engine can obtain an optimal valve lift in full speed range.

The technical problem of the invention is solved by the following technical solution: a variable valve lift device of an internal combustion engine, comprising a roller rocker arm lift mechanism and a driving mechanism; a cam and a roller of the roller rocker arm lift mechanism cooperates with each other so as to control the valve lift; the driving mechanism can output a straight-line displacement driving force; the roller rocker arm lift mechanism further includes a second rocker arm, wherein one end of the second rocker arm is connected with an output portion of the driving mechanism by a rotation pin so as to create a straight-line displacement by the driving force of the driving mechanism; the second rocker arm is provided with a slide track in the direction of the straight-line displacement; a rocker-arm pin in the center of valve rocker arms of the roller rocker arm lift mechanism is arranged in the slide track of the second rocker arm; and the rocker-arm pin can slide in the slide track of the second rocker arm.

Preferably, the driving mechanism comprises a linear motor and an output shaft; the linear motor drives the output shaft, and the output shaft is connected with the second rocker arm through the rotation pin.

Preferably, the driving mechanism comprises a control motor, an output shaft, a gear and a rack; the control motor drives the output shaft so as to rotate the gear, and the gear engages with the rack which is connected with the second rocker arm through the rotation pin.

Preferably, the driving mechanism comprises a control motor, a worm, a worm wheel, an output shaft, a gear and a rack; the control motor drives the worm and the worm wheel; the output shaft rotates coaxially with the worm wheel and the output shaft drives the gear in rotation; the gear engages with the rack which is connected with the second rocker arm through the rotation pin.

Preferably, the device is used to control the lifts of two valves, the first valve rocker arm and the second valve rocker arm share one rocker arm pin, one roller and one cam; the roller rocker arm lift mechanism further comprises a first rocker arm, wherein one end of the first rocker arm is hinged to the rocker arm pin, a roller pin of the roller is hinged to the other end of the first rocker arm, and the roller pin is arranged in the slide track of the second rocker arm after protruding out of the other end of the first rocker arm; the roller pin can slide in the slide track of the second rocker arm.

Preferably, one end of the first valve rocker arm and one end of the second valve rocker arm are connected with a first valve and a second valve respectively, the other ends of the first valve rocker arm and the second valve rocker arm are propped up by a first tappet and a second tappet respectively; the roller pin and the rocker arm pin slide in the slide track of the second rocker arm.

The advantageous effects of the invention over the prior art lies in that the variable valve lift device of an internal combustion engine of invention adopts the technical solution in which the position of the fulcrum of the second rocker arm relative to the rocker-arm pin is adjustable, and a motor controls the valve lift, which can be flexibly adjusted according to actual working conditions of the internal combustion engine, thus providing a continuous variable valve lift from low speed to high speed so that the internal combustion engine provides an optimal valve lift in the full range of working conditions, and fuel economy and power performance of the internal combustion engine can be improved. The structure and control system of the invention is simple and the response speed is fast.

BRIEF DESCRIPTION OF THE DRAWINGS

The present invention is further described in detail with reference to the accompanying drawings and embodiments.

DETAILED DESCRIPTION OF THE INVENTION

A variable valve lift device of an internal combustion engine according to the present invention includes a driving mechanism and a roller-rocker arm lift mechanism. Three embodiments are described in detail hereinafter. It is noted that the constitution and connection of the roller-rocker arm lift mechanisms of the three embodiments are substantially the same. Therefore, only one view showing the elements of the roller-rocker arm lift mechanism is provided herein.

Figure 1:
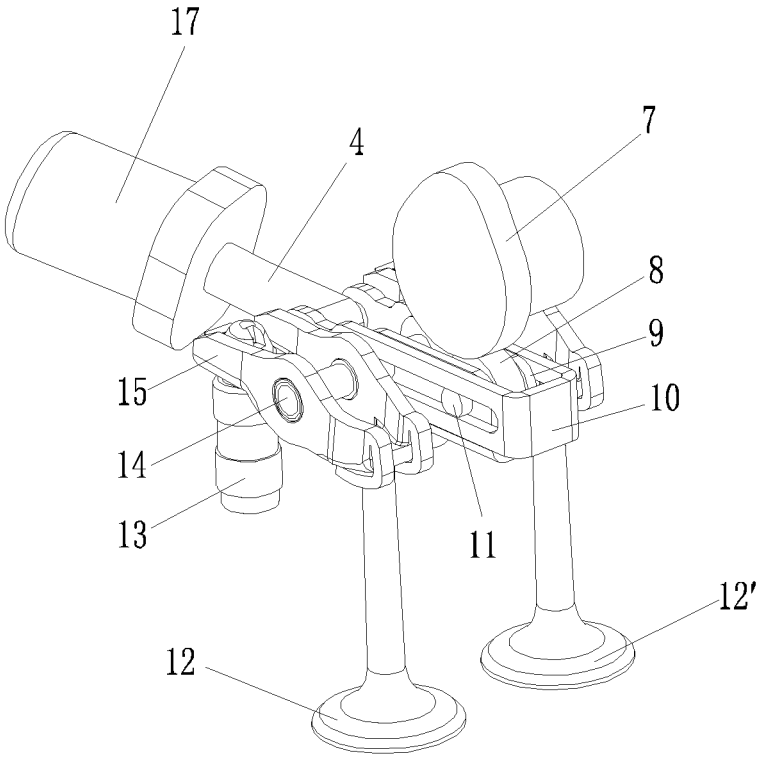
FIG. 1 is a schematic structural view of the variable valve lift device of an internal combustion engine according to a first embodiment of the present invention.

As shown in FIG. 1, the driving mechanism of the variable valve lift device of an internal combustion engine according to the first embodiment of the present invention includes a linear motor 17 and an output shaft 4. With additional reference to FIG. 4, the linear motor 17 drives the output shaft 4 so as to bring a rotation pin 16 in motion. The fact that the linear motor 17 drives the rotation pin 16 directly in motion can save a lot of intermediate transmission mechanisms, quicken the response speed of the system, and improve the accuracy of the system.

The roller-rocker arm lift mechanism includes a cam 7, a roller 8, a first rocker arm 9, a second rocker arm 10 having a slide track, a roller pin 11, a first valve 12, a second valve 12', a first tappet 13, a second tappet 13', a rocker-arm pin 14, a first valve rocker arm 15 and a second valve rocker arm 15'. The cam 7 drives the roller 8 arranged in the first rocker arm 9. The first rocker arm 9 has one end connected with the rocker-arm pin 14 and the other end connected with the second rocker arm 10 via the roller pin 11. The second rocker arm 10, the first valve rocker arm 15 and the second valve rocker arm 15' are connected through the rocker-arm pin 14. The first valve rocker arm 15 has one end connected with the first valve 12 and the other end propped up by the first tappet 13. The second valve rocker arm 15' has one end connected with the second valve 12' and the other end propped up by the second tappet 13'. Both the roller pin 11 and the rocker-arm pin 14 slide in the slide track of the second rocker arm 10. The rocker-arm pin 14 penetrates the first valve rocker arm 15 and the second valve rocker arm 15' on both sides thereof, and the rocker-arm pin 14 therefore moves with the movement of the first valve rocker arm 15 and the second valve rocker arm 15', all of which swing up and down around the vertexes of the first tappet 13 and the second tappet 13'. The rocker-arm pin 14 and the roller pin 11 are connected by the first rocker arm 9 and both slide synchronously in the slide track of the second rocker arm 10. Therefore, the axis of the roller pin 11 remains its position relative to the rocker arm 14 unchanged while moving around the rotation pin 16.

The first valve 12 and the second valve 12' are arranged on a cylinder and controlled by the first valve rocker arm 15 and the second valve rocker arm 15' respectively so as to open and close the intake valve and exhaust valve at an appropriate time and to enable the internal combustion engine to reach an appropriate lift. The first rocker arm 9, which takes the axis of the rotation pin 16 as its rotation axis, slides synchronously in the slide track of the second rocker arm 10 with the rocker-arm pin 14 so as to ensure that the roller 8 remains a fixed position relative to the cam 7 and there is always a good contact between the roller 8 and the cam 7. The second rocker arm 10 rotates with the axis of the rotation pin 16 as its rotation axis and moves left and right with the movement of a rack 6, which serves to provide a variable rocker arm with a variable range as shown in FIG. 5.

Figure 5:
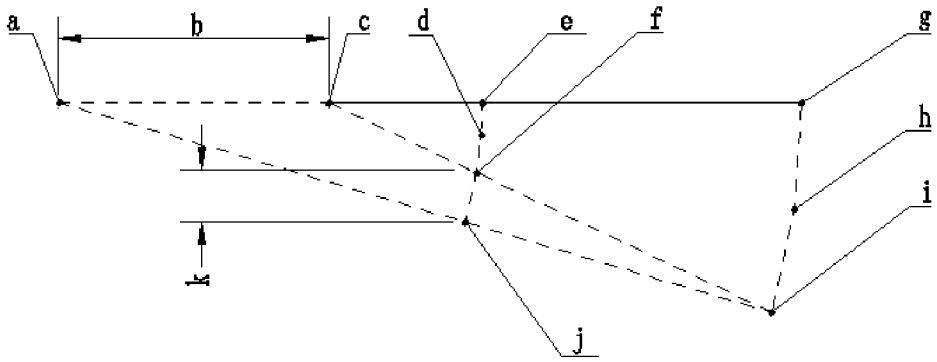
FIG. 5 is a schematic view showing the kinematic trajectory of the lift device of an internal combustion engine according to the present invention.

FIG. 5 is a schematic view showing the kinematic trajectory of the variable valve lift device of an internal combustion engine according to the present invention, wherein: "a" represents the central position of the rotation pin 16 in case of the maximum valve lift; "b" represents the moveable range of the center of the rotation pin 16; "c" represents the central position of the rotation pin 16 in case of the minimum valve lift; "d" represents the kinematic trajectory of the rocker-arm pin 14; "e" represents the initial point of the center of the rocker-arm pin 14; "f" represents the terminal point of the rocker-arm pin 14 in case of the minimum travel of the center of the rocker-arm pin 14; "g" represents the initial point of the center of the roller pin 11; "h" represents the kinematic trajectory of the roller pin 11; "i" represents the terminal point of the center of the roller pin 11; "j" represents the terminal point of the rocker-arm pin 14 in case of the maximum travel of the center of the rocker-arm pin 14; and "k" represents the adjustable range of the travel of the rocker-arm pin 14.

Figure 6:
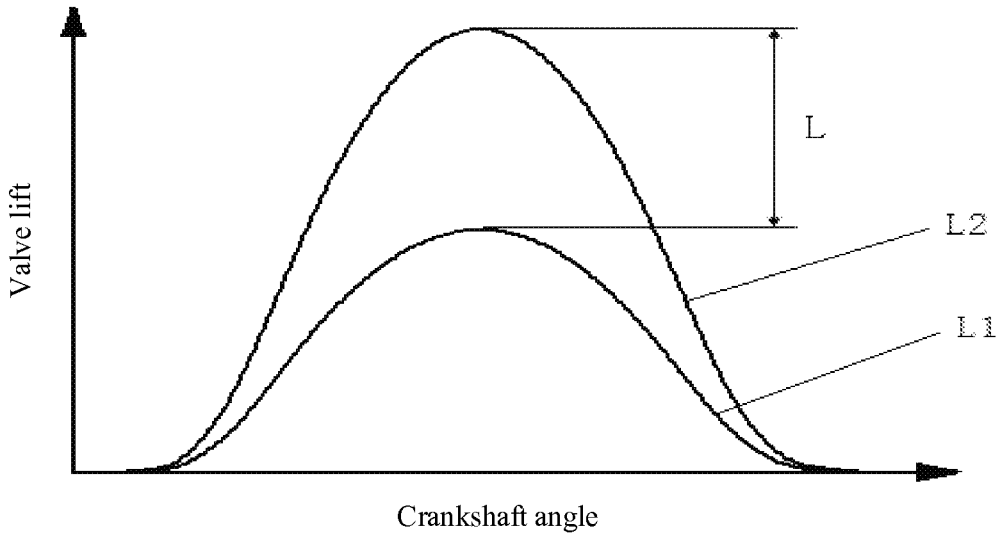
FIG. 6 is a schematic view showing the profile lines of valve lift of the lift device of an internal combustion engine according to the present invention.

FIG. 6 is a view showing the profile lines of valve lift created by the rocker arm pin 14 driving the first valve rocker arm 15 and the second valve rocker arm 15'. The two profile lines in FIG. 6 are profile lines of the valve lift, which are created at the existing opening and closing timing of the first valve 12 and the second valve 12', wherein L1 is a minimum lift created by the variable valve lift device of an internal combustion engine of the present invention, and L2 is a maximum lift created by the variable valve lift device of an internal combustion engine of the present invention. All the profile lines of the valve lift created by the present invention range between the two profile lines as shown in FIG. 6, and L represents the adjustable range of the valve lift. The corresponding lifts of each profile line at every moment are in an equal ratio relationship, i.e. the corresponding lift ratio of two arbitrary profile lines of valve lift at two arbitrary moments is constant with another.

The operational principle of the present invention is explained as follows: when the valve lift reaches to a certain degree, the cam 7 drives the roller 8 in rotation to swing around the rotation pin 16, the roller 8 drives the second rocker arm 10 by means of the roller pin 11 to swing around the rotation pin 16 which servers as the rotation center, the second rocker arm 10 drives the rocker-arm pin 14 to bring the first valve rocker arm 15 and the second valve rocker arm 15' in rotation together around the vertexes of the first tappet 13 and the second tappet 13', thereby driving the first valve 12 and the second valve 12' to open and close periodically at an appropriate lift. If the working condition point of the internal combustion engine varies, the ECU sends an instruction to start the linear motor 17. The linear motor 17 drives the output shaft 4 in motion, and the output shaft 4 in turn transfers the motion to the rotation pin 16 so that the rotation pin 16 moves synchronously. The adjustable range is shown at "b" in FIG. 5. The rotation pin 16 moves, while the initial positions of the rocker-arm pin 14 and the roller pin 11 remain unchanged. The center of the roller pin 11 is equivalent to the control end of a lever, the center of the rotation pin 16 is equivalent to a fulcrum, and the center of the rocker-arm pin 14 is equivalent to an intermediate point. That is, the position of the control end of the lever is invariable, while the position of the fulcrum is adjustable. Thus, the maximum travel of the intermediate point changes, thereby enabling the rocker-arm pin 14 to generate an adjustable range as shown at "k" in FIG. 5.

Figure 2:
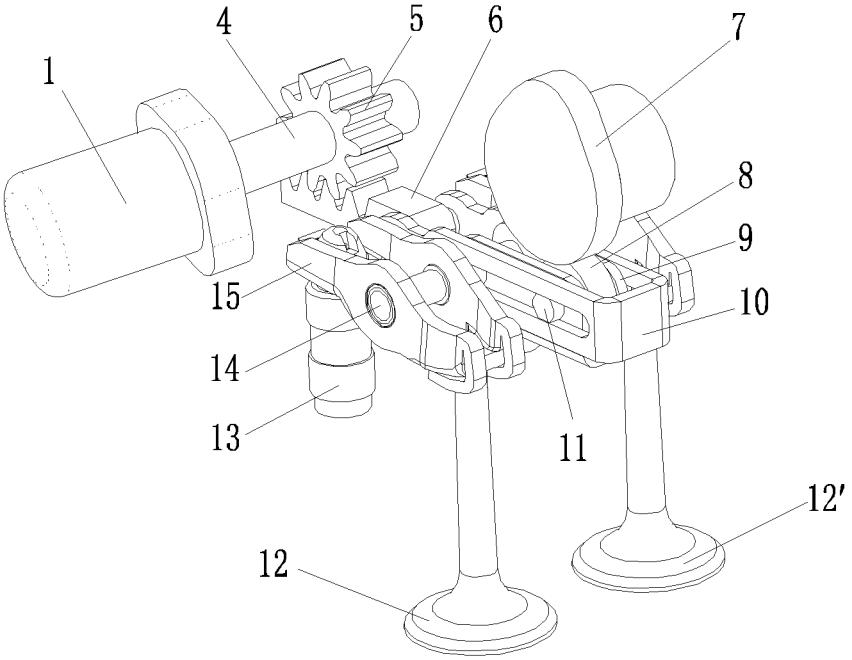
FIG. 2 is a schematic structural view of the variable valve lift device of an internal combustion engine according to a second embodiment of the present invention.

As shown in FIG. 2, the driving mechanism of the variable valve lift device of an internal combustion engine according to the second embodiment of the present invention includes a control motor 1, an output shaft 4, a control gear 5 and a rack 6. The control motor 1 drives the output shaft 4 to bring the gear 5 in rotation and the gear 5 engages with the rack 6, which is connected with the second rocker arm 10 through the rotation pin 16 and is driven by the gear 5. The roller rocker arm lift mechanism of the variable valve lift device of an internal combustion engine according to the second embodiment of the present invention is the same as that of the first embodiment, and the operational principle thereof is substantially the same as that of the first embodiment.

Figure 3:
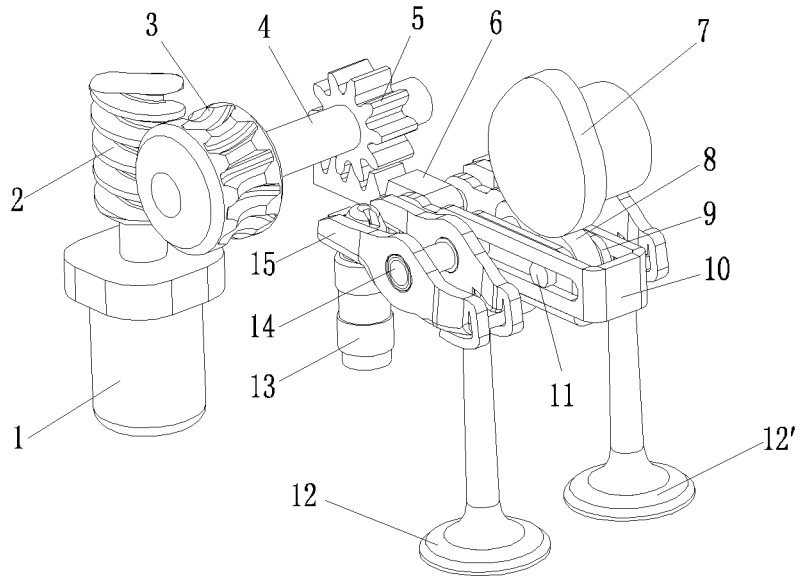
FIG. 3 is a schematic structural view of the variable valve lift device of an internal combustion engine according to a third embodiment of the present invention.
Figure 4:
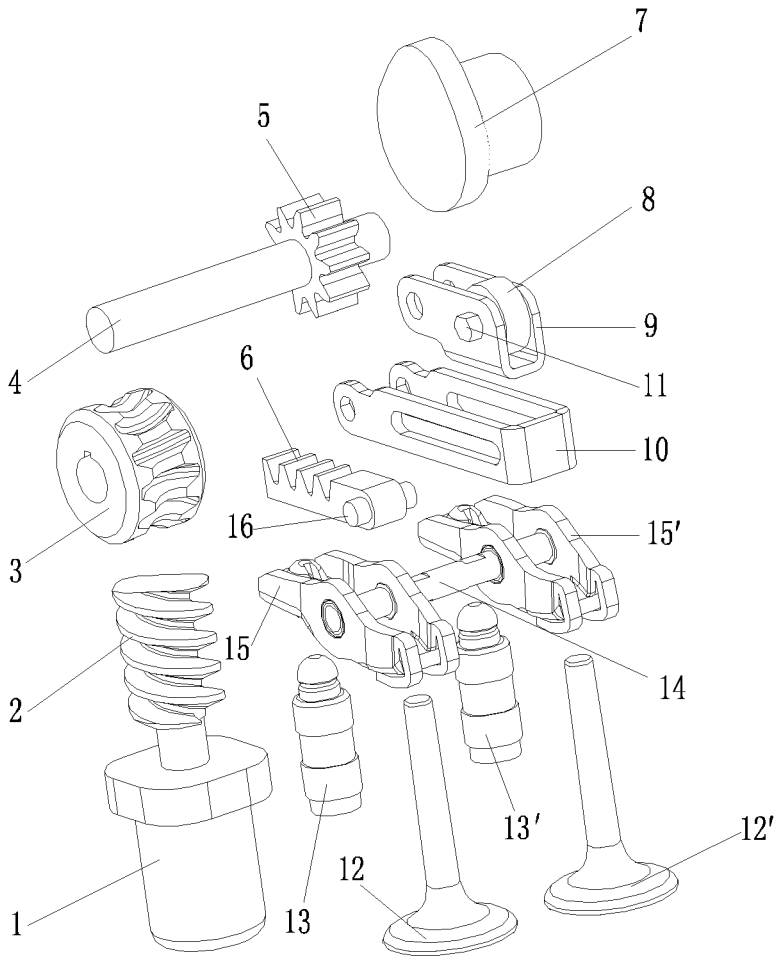
FIG. 4 is an exploded view showing elements of the variable valve lift device of the internal combustion engine according to the third embodiment of the present invention.

As shown in FIG. 3 and FIG. 4, the driving mechanism of the variable valve lift device of an internal combustion engine according to the third embodiment of the present invention includes a control motor 1, a worm 2, a worm wheel 3, an output shaft 4, a control gear 5, a rack 6 and a rotational shaft 16. The control motor 1 drives the worm 2 and the worm wheel 3, and drives the gear 5 in rotation through the output shaft 4. The gear 5 engages with the rack 6 and transfers the motion to the rotation pin 16 to drive the rotation pin 16 in motion. The roller rocker arm lift mechanism of the variable valve lift device of an internal combustion engine according to the third embodiment of the present invention is the same as that of the first embodiment, and the operational principle thereof is the same as that of the first embodiment. The variable valve lift device of an internal combustion engine according to the present invention adopts a motor to control the valve lift, which can be flexibly adjusted according to actual working conditions of the internal combustion engine, thereby providing a continuous variable valve lift from a low speed to a high speed so that the internal combustion engine provides an optimal valve lift in the full range of working conditions, and fuel economy and power performance of the internal combustion engine can be improved. The principle, structure and control system of the present invention is simple and the response speed is fast.

The above content is a further detailed description of the present invention made in combination with particular preferred embodiments, and it should not be considered that the specific implement of the present invention is limited to the description. Those with ordinary skills in the art can also, under the premise of not departing the concept of the present invention, make several simple deductions or substitutions, which should all be considered as falling within the scope of protection of the present invention.

The invention claimed is:

1. A variable valve lift device of an internal combustion engine, comprising a roller-rocker arm lift mechanism, a cam and a roller of the mechanism cooperating with each other to facilitate the control of a valve lift, and further comprising:

a driving mechanism, which outputs a straight-line displacement driving force; and the roller-rocker arm lift mechanism further comprising:

a second rocker arm, wherein one end of the second rocker arm is connected with an output portion of the driving mechanism through a rotation pin so as to create a straight-line displacement by the driving force of the driving mechanism; the second rocker arm is provided with a slide track in the direction of the straight-line displacement; a rocker-arm pin in the center of valve rocker arms of the roller-rocker arm lift mechanism is arranged in the slide track of the second rocker arm; the rocker-arm pin is slidable in the slide track of the second rocker arm; and wherein the roller-rocker arm lift mechanism further comprises a first rocker arm which has one end hinged to the rocker-arm pin and the other end hinged to a roller pin of the roller, and wherein the roller pin is arranged in the slide track of the second rocker arm after protruding out of the other end of the first rocker arm; and the roller pin is slidable in the slide track of the second rocker arm.

2. The variable valve lift device of an internal combustion engine according to claim 1, wherein the driving mechanism comprises a linear motor and an output shaft; the linear motor drives the output shaft which is connected with the second rocker arm through the rotation pin.

3. The variable valve lift device of an internal combustion engine according to claim 2, wherein the device controls adapted to control lifts of two valves, a first valve rocker arm and a second valve rocker arm share one rocker-arm pin, one roller and one cam.

4. The variable valve lift device of an internal combustion engine according to claim 1, wherein the driving mechanism comprises a control motor, an output shaft, a gear and a rack; the control motor drives the output shaft to bring the gear in rotation, and the gear engages with the rack which is connected with the second rocker arm through the rotation pin.

5. The variable valve lift device of an internal combustion engine according to claim 4, wherein the device controls lifts of two valves, a first valve rocker arm and a second valve rocker arm share one rocker-arm pin, one roller and one cam.

6. The variable valve lift device of an internal combustion engine according to claim 1, wherein the driving mechanism comprises a control motor, a worm, a worm wheel, an output shaft, a gear and a rack; the control motor drives the worm and the worm wheel, the output shaft rotates coaxially with the worm wheel and brings the gear in rotation, the gear engages with the rack which is connected with the second rocker arm through the rotation pin.

7. The variable valve lift device of an internal combustion engine according to claim 6, wherein the device controls lifts of two valves, a first valve rocker arm and a second valve rocker arm share one rocker-arm pin, one roller and one cam.

8. The variable valve lift device of an internal combustion engine according to claim 1, wherein the device controls lifts of two valves, a first valve rocker arm and a second valve rocker arm share one rocker-arm pin, one roller and one cam.

9. The variable valve lift device of an internal combustion engine according to claim 8, wherein one end of the first valve rocker arm and one end of the second valve rocker arm are connected with a first valve and a second valve respectively, the other ends of the first valve rocker arm and the second valve rocker arm are propped up by a first tappet and a second tappet respectively; the roller pin and the rocker arm pin slide in the slide track of the second rocker arm.

* * * * *